United States Patent [19]

Vorst

[11] Patent Number: 4,727,364

[45] Date of Patent: Feb. 23, 1988

[54] METHOD AND APPARATUS FOR INTENSITY SHADING IN A VISUAL DISPLAY

[75] Inventor: Carl J. Vorst, St. Louis, Mo.

[73] Assignee: McDonnell Douglas Corporation, St. Louis, Mo.

[21] Appl. No.: 652,584

[22] Filed: Sep. 19, 1984

[51] Int. Cl.[4] ..... G09G 1/16

[52] U.S. Cl. ..... 340/729; 340/744; 340/747; 340/972; 358/104

[58] Field of Search ..... 340/729, 742, 744, 728, 340/747, 703, 971, 972, 976; 358/104

[56] References Cited

U.S. PATENT DOCUMENTS

| | | | |
|---|---|---|---|
| 3,976,991 | 8/1976 | Hickin et al. | 340/742 |
| 4,095,145 | 6/1978 | Terranova et al. | 340/742 X |
| 4,251,755 | 2/1981 | Bryden | 340/742 X |
| 4,348,184 | 9/1982 | Moore | 340/729 X |
| 4,538,144 | 8/1985 | Yamagami | 340/729 X |

*Primary Examiner*—Gerald L. Brigance

*Attorney, Agent, or Firm*—Polster, Polster and Lucchesi

[57] ABSTRACT

An apparatus for generating computed images on an electronically controlled display surface is provided with an improved intensity shading generator. The shading generator operates by assigning each scan line of a raster display a fixed intensity between first and second points. The sweep position is monitored and each succeeding scan line between an initial position and a break point position of the image is monitored. The sweep intensity is incremented for each sweep line until the break point is reached, at which time new values for intensity are generated. The shading generator of this invention greatly reduces the bandwidth required to generate accurately placed intensity gradients perpendicular to the horizon in a displayed image system.

14 Claims, 4 Drawing Figures

METHOD AND APPARATUS FOR INTENSITY SHADING IN A VISUAL DISPLAY

BACKGROUND OF THE INVENTION

This invention relates to the generation and display of computed images, and more specifically, to visual presentations finding application in aircraft flight simulators. While the invention is described in particular detail with respect to such visual simulation use, those skilled in the art will recognize the wider applicability of the inventive principles disclosed hereinafter.

The U.S. Pat. No. 3,996,673, to Vorst et al, describes an apparatus for generating computed images on an electrically controlled display means. The entire disclosure of U.S. Pat. No. 3,996,673 ('673) is incorporated herein by reference. In the '673 patent, a particular device which provided the shading required for realistic image enhancement was disclosed. The means for varying the intensity of an image formed on a raster display disclosed in the '673 patent was operated by interpolating a known, required intensity set at the four corners of the display, and assigning an intensity value for each raster line between the top and bottom based on that interpolation. While the device and method disclosed in the '673 patent works well for its intended purpose, the embodiment disclosed did not lend itself to all simulation aspects. In particular, low visibility effects are an important part of visual simulation. Low visibility, in order to be realistic in the simulator context, should have similar effects on light points displayed in the image, and other surface attenuation. Intensity extinction positions for both should be well controlled. In addition, it is desirable to provide a smooth transistion from ground imagery to ground haze to sky, over a relatively narrow band of the display area, in order to enhance the image in a realistic manner.

The intensity interpolation utilized in conjunction with the '673 patent, while working well for its intended purpose, is not easily adaptable to the problems present with ground haze sky transition present in the art and described above.

It is possible to define, store and display in real time the intensity for each picture element (pixel) in a visual simulation system based on individual pixel digital processing, even though this is an extremely complex process. In a visual display system based on an image related scan, the process becomes exceedingly difficult because of the lack of pixel "bookkeeping". That is to say, as the picture drawing beam moves between the boundaries of the surface being drawn, the exact coordinates of the beam at a particular instance in time are not available in digital form.

The raster line shader described herein solves the problem of low visibility "effects" generation for an image related scanned simulation system. The invention disclosed hereinafter computes and displays intensity without need for individual pixel processing. The raster line shader uses digital computations which provides the needed accuracy providing low visibility effects and an earth sky haze band. These computations take advantage of the approximately constant intensity over a raster line when the raster line is parallel to the simulated horizon.

One of the objects of this invention is to provide an improved raster shader for a computer generated display.

Another object of this invention is to provide a device which produces an improved shading function for a computer generated display.

Another object of this invention is to provide a raster shading device which is compatible with aircraft simulators presently being sold commercially.

Another object of this invention is to provide a low cost shading device for an image generator.

Other objects of this invention will be apparent to those skilled in the art in light of the following description and accompanying drawings.

SUMMARY OF THE INVENTION

In accordance with this invention, generally stated, a raster line shader is provided which permits the assignment of a fixed intensity to each raster line. In the preferred embodiment, the shader is employed to provide desired intensity variation during the sweep of a cathode ray tube (CRT). The shader is provided with initial parameters from an external computering device. The raster line shader incrementally constructs an intensity profile by starting with an initial intensity at a start point. As the vertical position of the sweep changes, an intensity increment is added to the start point intensity. The vertical sweep position change, intensity increment-add sequence continues until a vertical break point is reached, at which time a new intensity increment is used. Reaching the highest vertical position of the intensity function terminates the sequence.

DESCRIPTION OF THE PREFERRED EMBODIMENT

Figure 1:
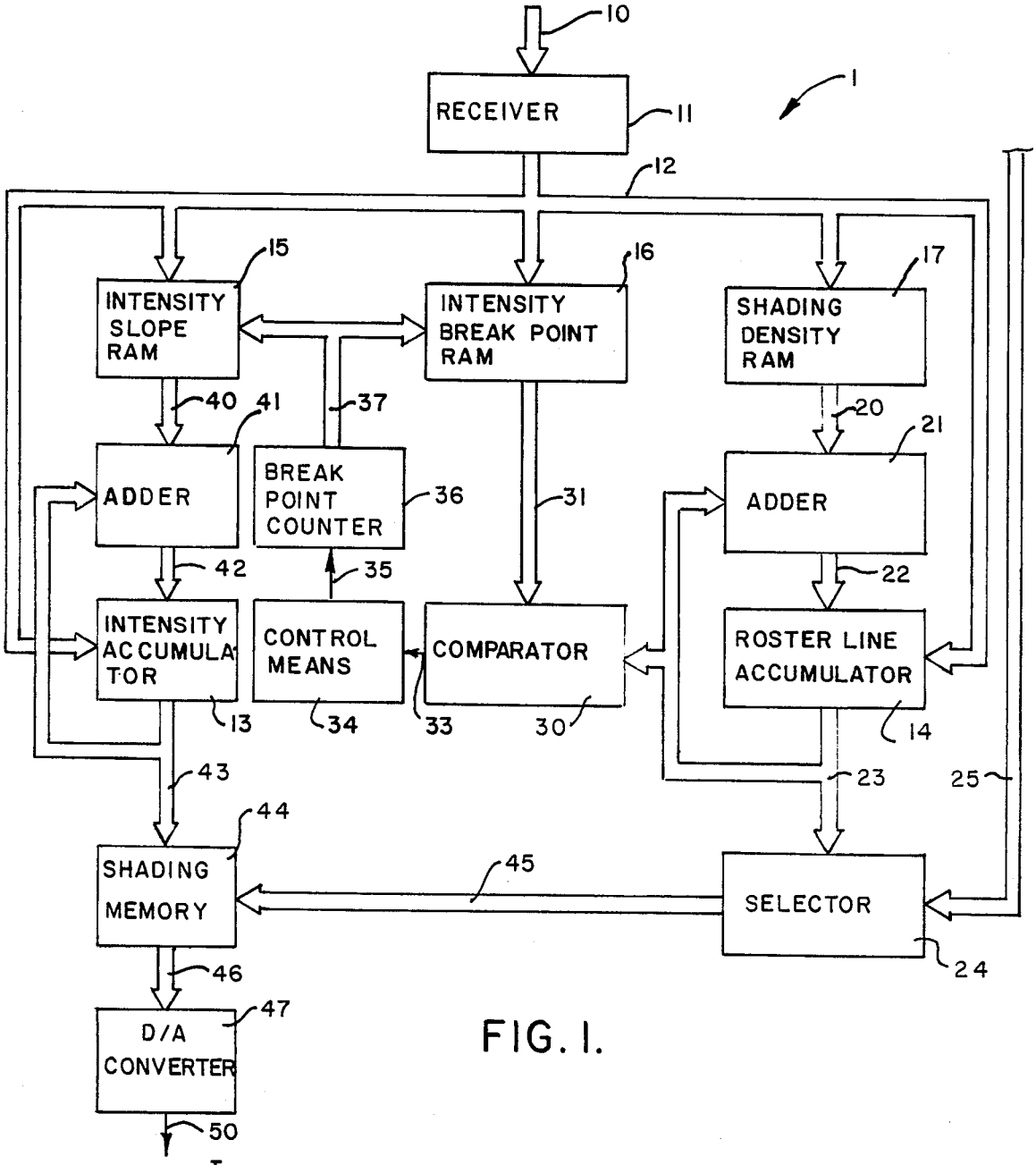
FIG. 1 is a block diagrammatic view of one illustrative embodiment of raster line shader of this invention.

Referring now to the FIG. 1, reference numeral 1 indicates one illustrative embodiment of raster line shader of this invention.

As indicated above, the disclosure of the Vorst et al U.S. Pat. No. 3,996,673 is incorporated herein by reference. That patent relates to a device for generating the control voltage for a display means in which the outline points of the image form an input the device. Means for generating edge vectors from and between a start and respective ones of the outlying points are provided and include a right edge and a left edge vector generator. The desired image is constructed by sweeping the CRT beam in the X coordinate direction and comparing the instantaneous beam position with the left edge and right edge vectors. Upon comparison, beam intensity if blanked, the Y coordinate of the beam incremented, the beam direction is reversed, the beam intensity is again unblanked, and new edge values generated. Means are provided for comparing the Y coorindate position of the beam with the known outlying points. When corresponding Y coordinate points are detected, new left edge and right edge vectors are generated, and the operation is repeated until a closed figure is obtained.

The '673 patent also employs a shading function generator for providing a depth cue to an observer of the generated image by varying image intensity. In the system disclosed in the '673 patent, the intensity of the corner points of the display are determined. Those values, along with the instantaneous position of the beam, are utilized to interpolate the image intensity for all points within the display window.

While the intensity shading function of the 673 patent works well, the system is hard to adapt to the increased fidelity requirements for visual simulation systems, as for example, the narrow earth haze sky band attenuation present in real flight situations. As indicated above, that visual cue heretofore has been difficult to provide in a simulator context. The shader 1 is compatible with the system described in the '673 patent, when used in conjunction with a device for rotation of the raster to parallism with the simulated horizon. The raster rotation device uses a commonly implemented technique to accomplish its purpose.

The system employs a conventional cartesian coordinate system having a vertical axis (Y axis), a horizontal axis (X axis), and an intensity axis generally providing an illusion of depth corresponding to the Z axis of the system.

Figure 2:
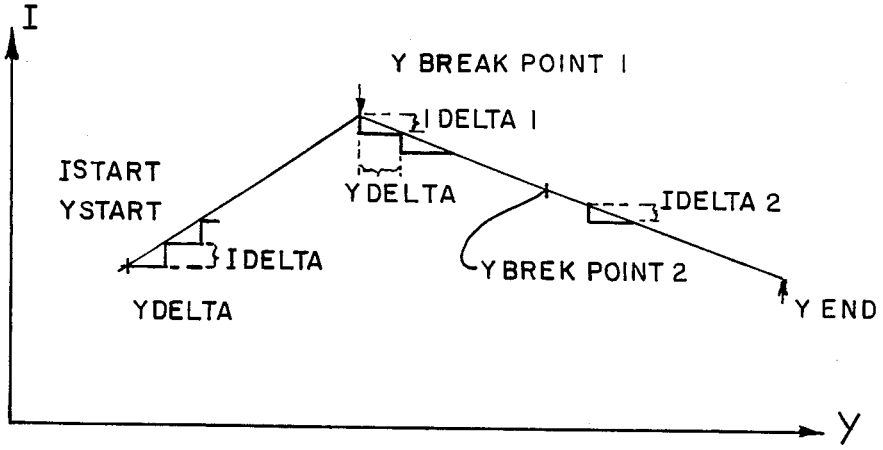
FIG. 2 is a diagrammatic representation useful in explaining the operation of the shading function generator illustrated in FIG. 1.

FIG. 2 illustrates the raster line shading process. A taper function is described by:

Y start=lowest vertical position of the taper function
I start=intensity at Y start
I delta=intensity step size
Y delta=Y range for which each I is valid
Y break point=Y' value at which new I delta, Y delta are used
Y end=highest vertical position of the taper function.

At the beginning of a display interval, before any imagery is drawn, the above parameters form an input to the raster line generator 1 from an external computing device, conventionally a computer adapted for simulator functions.

The raster line shader 1 interactively constructs an intensity profile by starting with an initial intensity of I start at Y start. Y is incremented and I delta added to I start. The increment-add sequence continues until Y break point is reached, at which time a new I delta is used. Reaching Y end terminates the sequence.

Referring now to FIG. 1, the parameters form an input to the raster shader 1 along a data bus 10. The data bus 10 is operatively connected to a suitable receiver 11, which receives the input data and distributes it to the remaining portions of the shader 1. Receiver 11 is operatively connected by a bus 12 to an intensity accumulator 13, a raster line accumulator 14, an intensity slope random access memory (RAM) 15, an intensity break point random access memory (RAM) 16, and a shading density random access memory (RAM) 17. Initial intensity (I start) is an input on the bus 12 to the intensity accumulator 13. Initial raster line number (Y start) is an input via the bus 12 to the raster line accumulator 14. Y delta information is stored in a shading density ram 17. Y break point information is stored in the intensity break point ram 16. Intensity step size I delta is stored in intensity slope ram 15.

An output side 20 of shading density ram 17 is an input to an adder means 21. An output side 22 of adder means 21 is an input into the raster line accumulator 14. An output side 23 of raster line accumulator 14 is an input to a selector means 24. Selector means 24 also has an input side connected to a bus 25 which provides surface information to the selector 24, as later described in greater detail.

The output 23 of the raster line accumulator 14 also is an input to the adder 21, and to a comparator 30. The comparator 30 has an input operatively connected to an output 31 of the intensity break point ram 16. Comparator 30 has an output 33 operatively connected to a control means 34. Control means 34 has an output 35 operatively connected to a break point counter 36. The break point counter 36 has an output 37 operatively connected to the intensity break point ram 16 and to the intensity slope ram 15. The intensity slope ram 15 has an output side 40 operatively connected to an adder 41. An output 42 of the adder 41 is an input to the intensity accumulator 13. An output 43 of the intensity accumulator 13 is an input to the adder 41, and is a first input to a shading memory 44. A second input 45 of the shading memory 44 is operatively connected to the output side of selector 24.

An output side 46 of shading memory 44 is operatively connected to a digital-to-analog (D/A) converter 47. The D/A converter 47 has an output side 50 which provides intensity information for the sweep. Sweep voltages may be applied to a conventional raster scan display, which may be a conventional CRT if desired.

Operation of the shader 1 is relatively simple to understand. The initial intensity (I start) and the initial raster line number (Y start) are loaded into the intensity accumulator 13 and the raster line accumulator 14. The raster line number, or Y axis position of the sweep is incremented by adding a vertical increment value Y delta, which is stored in the shading density ram 17. For each addition of Y delta, a corresponding increment, I delta, stored in the intensity slope ram 15, is added to the contents of the intensity accumulator 13 through the adder 41. Each resulting intensity value is stored in the shading memory 44 at an address value equal to the raster line number in the raster line accumulator 14.

The raster line accumulator output 23 is compared to a value, Y break point, stored in the intensity break point ram 16 in the comparator 30. At the point of comparison, the control means 34 increments the break point counter 36. In turn, the break point counter 36 commands the use of a new I delta in the intensity slope ram 15 and new Y break point in the intensity break point ram 16. This continued operation results in a look up table of intensity versus raster line number in the shading memory 44.

As the image drawing portion of the display interval is entered, the shading memory 44 is activated to change to a read only mode. The Y value of the current raster line of a surface is supplied as an address to the shading memory 44 along the bus 25, selector 24 and input 45. That is to say, the Y value of the current raster line of a surface to be drawn on the face of a CRT is supplied as an address to the shading memory 44. The output of the shading memory 44 is an output at 46 to the digital-to-analog converter 47, whose output 50 is an analog intensity value. To prevent accessing empty memory locations, low order address bits are masked to correspond to the address granularity (Y delta) used during shading table generation.

Figure 3:
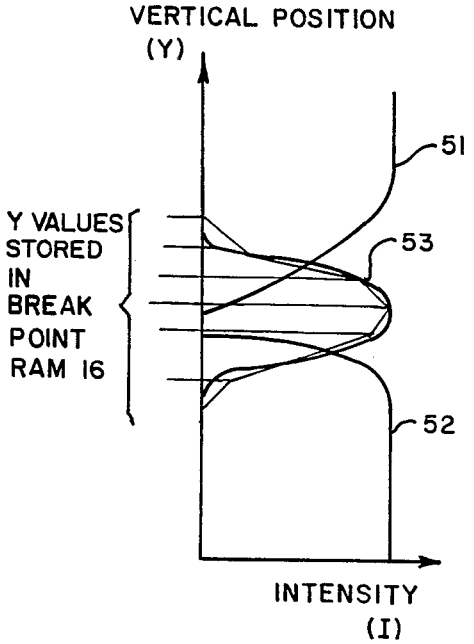
FIG. 3 is a diagrammatic representation useful in demonstrating the operation of the shading function generator illustrated in FIG. 1.
Figure 4:
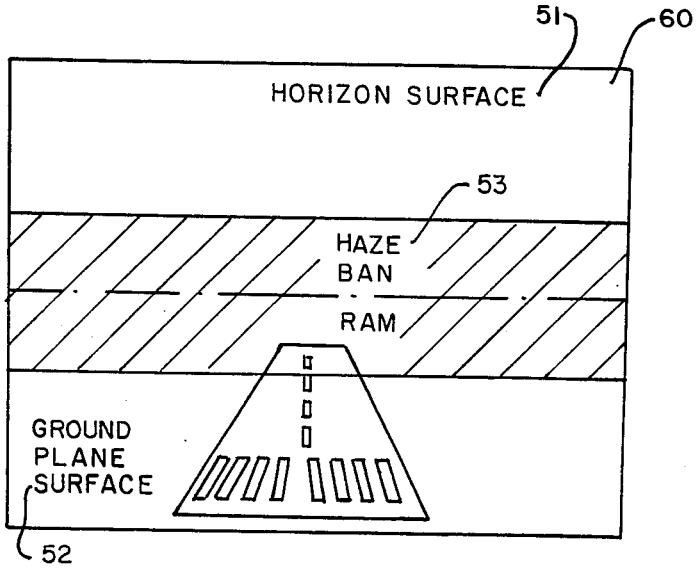
FIG. 4 is a diagrammatic representation useful in explaining the operation of the shading function generator illustrated in FIG. 1.

FIG. 4 is useful for explanational purposes. If a view plane 60, which for the purposes of this specification is taken to be a conventional CRT screen face, is placed perpendicular to the Z axis of a conventional Cartesian coordinate system, any line at constant eye-point Z distance intersects the view plane parallel to the horizon. By rotating the display scan lines to a position parallel to the horizon, each scan line may be assigned a fixed intensity, assuming that the difference between the Z distance and actual line of sight range can be neglected over the scan line's length. This is illustrated in a comparison of FIGS. 3 and 4, where a horizon or sky surface 51 is represented by a particular intensity 51, a haze band area 53 is represented by the numeral 53, and the ground surface plane is represented by an intensity curve 52. The Y values of the desired intensity are stored in the break point ram and these values are utilized in painting the raster surface.

As thus shown and described, a raster shader meeting all of the ends and objects hereinabove described has been set out.

Numerous variations, within the scope of the appended claims, will be apparent to those skilled in the art in light of the foregoing description and accompanying drawings. Thus, while the invention was described in conjunction with its particular application in intensity modulation, the shader also can be used for focus modulation in the axis perpendicular to the raster display structure. While straight line surfaces were illustratively utilized in the above description, curved shape generation is possible in other embodiments. The specification and/or drawings utilize the single conductors for electrically connecting various assemblies of the invention. Those skilled in the art will recognize that the diagrammatic illustration of a single conductor merely facilitates the verbal description of the circuit under consideration and the single conductor shown may be conductor pluralities in commercial embodiments of the invention. Although the device is described in conjunction with the display disclosed in the '673 patent, it may just as well be used in conjunction with conventional raster display devices. These variations are merely illustrative.

Having thus described the invention, what is claimed and desired to be secured by Letters Patent is:

1. In an apparatus for generating an image including a display means, said display means having a desired image visual output, the output being controlled electrically by applying selected control data to said display means for controlling a beam, an improvement which comprises means for varying the intensity of the image formed at said display means, said intensity varying means including means for receiving and storing an initial intensity value for a predetermined number of raster lines, means for receiving and storing an initial raster line number, means for receiving and storing a vertical position break point, means for receiving and storing incremental intensity values, means for generating a new intensity value for each of a predetermined number of successive raster lines by incrementing the initial intensity value by the incremental intensity value, the new intensity value then replacing the initial intensity value and means for selecting a new incremental intensity value when the beam reaches said vertical position break point so that the image at said display means is formed by a plurality of raster lines, individual ones of which initially have approximately constant intensity.

2. The improvement of claim 1 further including memory means for storing a plurality of intensity values, said memory means being operatively connected to said means for receiving and storing said initial intensity value.

3. The improvement of claim 2 wherein means for selecting a new intensity incremental value includes a comparator, said comparator comparing the present vertical raster line number with the value of said vertical position break point.

4. The improvement of claim 3 wherein said memory means has an output side, said output side being operatively connected to a digital-to-analog converter for providing an analog electrical signal to said display means.

5. In a display device including means for displaying an electronically generated image, said display means forming a viewing area, means for generating an image at said display by sweeping an electronic beam along parallel lines across said display, and means for generating said electronic beam, an improvement which comprises means for varying the intensity of an image formed at said display, said intensity varying means including means for receiving a predetermined intensity at the lowest vertical position of the image, said predetermined intensity receiving means being operatively connected to said image generating means, means for incrementing said predetermined intensity value for each of a predetermined number of successive raster line for the image above said initial raster line position, said assigning means being operatively connected to said image generating means, means for determining a break point for raster line increments forming said image, said break point determining means being operatively connected to said image generating means, and means for establishing a new predetermined intensity value at said break point.

6. The improvement of claim 5 further including memory means for storing the intensity values for each line of said display.

7. The improvement of claim 6 further including means for selectively addressing said memory means depending upon the position of said beam.

8. An apparatus for generating an image comprising:

display means, said display means having a desired image visual output, said output being controlled electronically by applying selected control data to said display means for controlling a beam;

means for generating an image for presentation operatively connected to said display means;

means for varying the intensity of the image generated by said image generating means, said intensity varying means being operatively connected between said image generating means and said display means, said intensity varying means including means for receiving and storing an initial intensity value, said initial intensity value receiving and storing means being operatively connected to said image generating means, means for receiving and storing an initial raster line number, said initial raster line number receiving and storing means being operatively connected to said image generating means, means for receiving and storing a vertical break point, said vertical break point receiving and storing means being operatively connected to said image generating means, means for receiving and storing an incremental intensity value, said incremental intensity value receiving and storing means being operatively connected to said image generating means, means for generating a new intensity value for each of a predetermined number of successive raster lines by incrementing the initial intensity value by the incremental intensity value, the new intensity value then replacing the initial intensity value, said incrementing means being operatively connected between said initial raster line storing means and said incremental intensity value storing means, and means for selecting a new incremental intensity value when the beam reaches said vertical break point, said image being formed by a plurality of raster lines, individual ones of which initially have approximately constant intensity.

9. The apparatus of claim 8 further including memory means for storing a plurality of intensity values, said memory means being operatively connected to said means for receiving and storing said initial intensity value.

10. The apparatus of claim 9 wherein means for selecting a new intensity incremental value includes a comparator, said comparator comparing the raster line number with the value of said vertical position break point.

11. The apparatus of claim 10 wherein said memory means has an output side, said output side being operatively connected to a digital-to-analog converter for providing an analog electrical signal to said display means.

12. In a device for forming an image including image generating means, display means operatively connected to said image generating means, said display means having a desired image visual output, the output being controlled electronically by applying selected control data to said display means for controlling a beam, an improvement which comprises means for varying the intensity of an image formed by said display means, said intensity varying means including an intensity accumulator operatively connected to said image generating means, a raster line accumulator operatively connected to said image generating means, means for incrementing and monitoring the vertical position of the beam, said incrementing and monitoring means being operatively controlled by said image generating means, means for receiving and storing an incremental intensity value, said incremental intensity value receiving and storing means being operatively connected to said image generating means, means for generating a new intensity value for each of a predetermined number of successive raster lines by incrementing the intensity value of the previous raster line by said incremental intensity value, means for comparing the vertical position of the beam with a vertical break point, and means for selecting a new incremental intensity value when the beam reaches the vertical break point, said image being formed by a plurality of raster lines, individual ones of which initially have approximately constant intensity.

13. The improvement of claim 12 further including memory means for storing a plurality of intensity values, said memory means being operatively connected to said intensity accumulator, said memory means having an output side.

14. The improvement of claim 13 further including a digital-to-analog converter operatively connected to the output side for said memory means.

* * * * *